US007752842B2

(12) United States Patent
Hristov et al.

(10) Patent No.: US 7,752,842 B2
(45) Date of Patent: Jul. 13, 2010

(54) CIRCUIT FOR CONTROLLING A DOUBLE-ACTION HYDRAULIC DRIVE CYLINDER

(75) Inventors: Ivan Hristov, Zug (CH); Josef Zürcher, Neuheim (CH)

(73) Assignee: Bucher Hydraulics AG, Neuheim (CH)

( * ) Notice: Subject to any disclaimer, the term of this patent is extended or adjusted under 35 U.S.C. 154(b) by 397 days.

(21) Appl. No.: 11/988,908

(22) PCT Filed: Jan. 27, 2006

(86) PCT No.: PCT/CH2006/000057

§ 371 (c)(1),
(2), (4) Date: Jan. 15, 2008

(87) PCT Pub. No.: WO2007/019712

PCT Pub. Date: Feb. 22, 2007

(65) Prior Publication Data

US 2010/0083651 A1 Apr. 8, 2010

(30) Foreign Application Priority Data

Aug. 19, 2005 (CH) ..... 1366/05

(51) Int. Cl.
*F15B 11/044* (2006.01)
*F15B 11/024* (2006.01)

(52) U.S. Cl. ..... 60/460; 91/464

(58) Field of Classification Search ..... 60/459, 60/460; 91/440, 459, 464
See application file for complete search history.

(56) References Cited

U.S. PATENT DOCUMENTS 5,415,076 A * 5/1995 Krone et al. ..... 91/440
5,826,486 A * 10/1998 Shimada ..... 60/460
5,996,465 A * 12/1999 Morikawa et al. ..... 91/458
6,092,454 A * 7/2000 Vande Kerckhove ..... 91/459
6,405,633 B1 * 6/2002 Dueckinghaus et al. ..... 91/436

OTHER PUBLICATIONS

English Translation of International Preliminary Report on Patentability issued in corresponding application No. PCT/CH2006/000057.

* cited by examiner

*Primary Examiner*—Thomas E Lazo
(74) *Attorney, Agent, or Firm*—Cohen Pontani Lieberman & Pavane LLP

(57) ABSTRACT

Circuit for controlling a double-action hydraulic drive cylinder includes a directional control valve having working ports A and B, a pump port P, and a tank port T, wherein the directional control valve has a neutral position in which pump port P is blocked and working ports A, B are connected to tank port T. A pressure-limiting valve and a controllable load-holding valve are connected to the piston space in parallel, and a regeneration check valve is connected in series between a connection point for the parallel components and the rod space. A first precharge valve is connected between the working port A and the connection point, and a first bypass check valve is connected anti-parallel parallel with the first precharge valve and the load-holding valve. A second precharge valve is connected in series with the directional control valve between the tank port P and the rod space.

5 Claims, 6 Drawing Sheets

CIRCUIT FOR CONTROLLING A DOUBLE-ACTION HYDRAULIC DRIVE CYLINDER

CROSS-REFERENCE TO RELATED APPLICATIONS

This is a U.S. national stage of International Application No. PCT/CH2006/000057, filed on 27 Jan. 2006. Priority is claimed on Swiss Application No. 1366/05, filed on 19 Aug. 2005.

BACKGROUND OF THE INVENTION

1. Field of the Invention

The invention pertains to a circuit for controlling a double-action hydraulic drive cylinder having a piston separating a piston space from a rod space, wherein hydraulic oil can be supplied to the piston space while hydraulic oil simultaneously flows out of the rod space, and hydraulic oil can be supplied to the rod space while hydraulic oil simultaneously flows out of the piston space, the cylinder being actuated by a directional control valve having working ports A and B, a pump port P, and a tank port T.

2. Description of the Related Art

Double-action drive cylinders are often used in devices for raising and lowering loads. In the one direction of movement, hydraulic oil is fed into the piston space of the drive cylinder, whereas hydraulic oil must be discharged from the rod space of the drive cylinder. Because the cross sections of the piston and rod spaces are different, the quantities of hydraulic oil fed in and discharged are also different. In the first direction of movement just mentioned, the amount of hydraulic oil which must be fed into the piston space is greater than that which flows out of the rod space. The situation is reversed for the other direction of movement.

If the inflow and outflow of hydraulic oil is controlled by a directional control valve, all of the hydraulic oil to be supplied to the piston space, for example, must be conveyed by a pump. The hydraulic oil flowing out of the rod space flows to the tank by way of the directional control valve.

A differential circuit is known from the publication Der Hydraulik Trainer (The Hydraulic Trainer), Vol. 2, Proportional and Servo Valve Engineering (Mannesmann Rexroth GmbH, 1st edition, ISBN 3-8023-0898-0). In this circuit, a spring-loaded check valve is installed in parallel to the directional control valve. When the pump conveys hydraulic oil via the directional control valve to the piston space, hydraulic oil flows out from the rod space via the check valve to the pump port of the directional control valve, because the return flow to the tank is blocked by the directional control valve. The pump must therefore convey only the differential quantity of hydraulic oil.

In the case of work machines in which such double-action drive cylinders are used, the pipelines between the directional control valve and the double-action drive cylinder are often very long, such as 8 meters or more. A long hydraulic oil line, however, represents a hydraulic resistance, which translates to energy losses and to the heating of the hydraulic oil.

Another circuit is known from U.S. Pat. No. 5,826,486. A circuit is designed here with a check valve between the feed line leading to the rod space and the feed line leading to the piston space. Thus hydraulic oil can flow from the rod space to the piston space without having to detour by way of the directional control valve. This at least partially solves the problems of energy losses and oil heating. So-called regeneration is therefore active when the rod travels out of the drive cylinder, which can mean, for example, that the load is being raised. When the rod travels inward, that is, when the load is being lowered, for example, no regeneration takes place. The entire quantity of hydraulic oil leaving the piston space of the hydraulic drive cylinder must be carried away to the tank via the directional control valve, whereas the quantity of hydraulic oil to be conveyed into the rod space must flow from the pump via the directional control valve. When the load is lowered, the pump must therefore provide power, and the entire quantity of hydraulic oil must flow through the long lines.

A controlled suspension circuit for an actuating device is known from U.S. Pat. No. 6,092,454. Here regeneration from the piston space to the rod space of a hydraulic drive cylinder is possible, but it requires additional control means, namely, a pilot-controlled check valve, which is actuated by an electrically controlled valve. The electrically controlled valve for its own part is actuated by a contact of a switch arrangement. In one of the embodiments, furthermore, a second pilot-controlled check valve is necessary, which is controlled by a proportional pressure control section. In the second embodiment shown, an additional outlet valve is required, which must be actuated by a second proportional pressure control section.

Regeneration of the piston space to the rod space is therefore possible in principle here, but it requires control measures and is tied to the presence of pilot-controlled check valves and their actuating elements. Hydraulically controlled valves and their actuating elements, which also act hydraulically, lead to pressure losses and thus impose a certain power demand.

SUMMARY OF THE INVENTION

The invention is based on the task of simplifying the hydraulic circuit while simultaneously achieving a further reduction in the power demand by minimizing the hydraulic flow resistances and thus reducing the degree to which the oil is heated.

According to the invention, the directional control valve has a neutral position in which the pump port P is blocked and the two working ports A, B are connected to the tank port T. A pressure-limiting valve and a controllable load-holding valve are connected to the piston space as a parallel circuit, and an automatic regeneration check valve is connected in series between the parallel circuit and the rod space. The regeneration check valve, the pressure-limiting valve, and the controllable load-holding check valve are connected to each other at a connection point. A first precharge valve is connected between the working port A and the connection point, the first precharge valve permitting flow from the connection point to the working port A. A first automatic bypass check valve is connected in parallel with the first precharge valve and the load-holding valve, the first automatic bypass check valve permitting flow from the working port A to the piston space. A second precharge valve is connected in series with the directional control valve between the tank port P and the rod space.

DETAILED DESCRIPTION OF THE PREFERRED EMBODIMENTS

Figure 1:
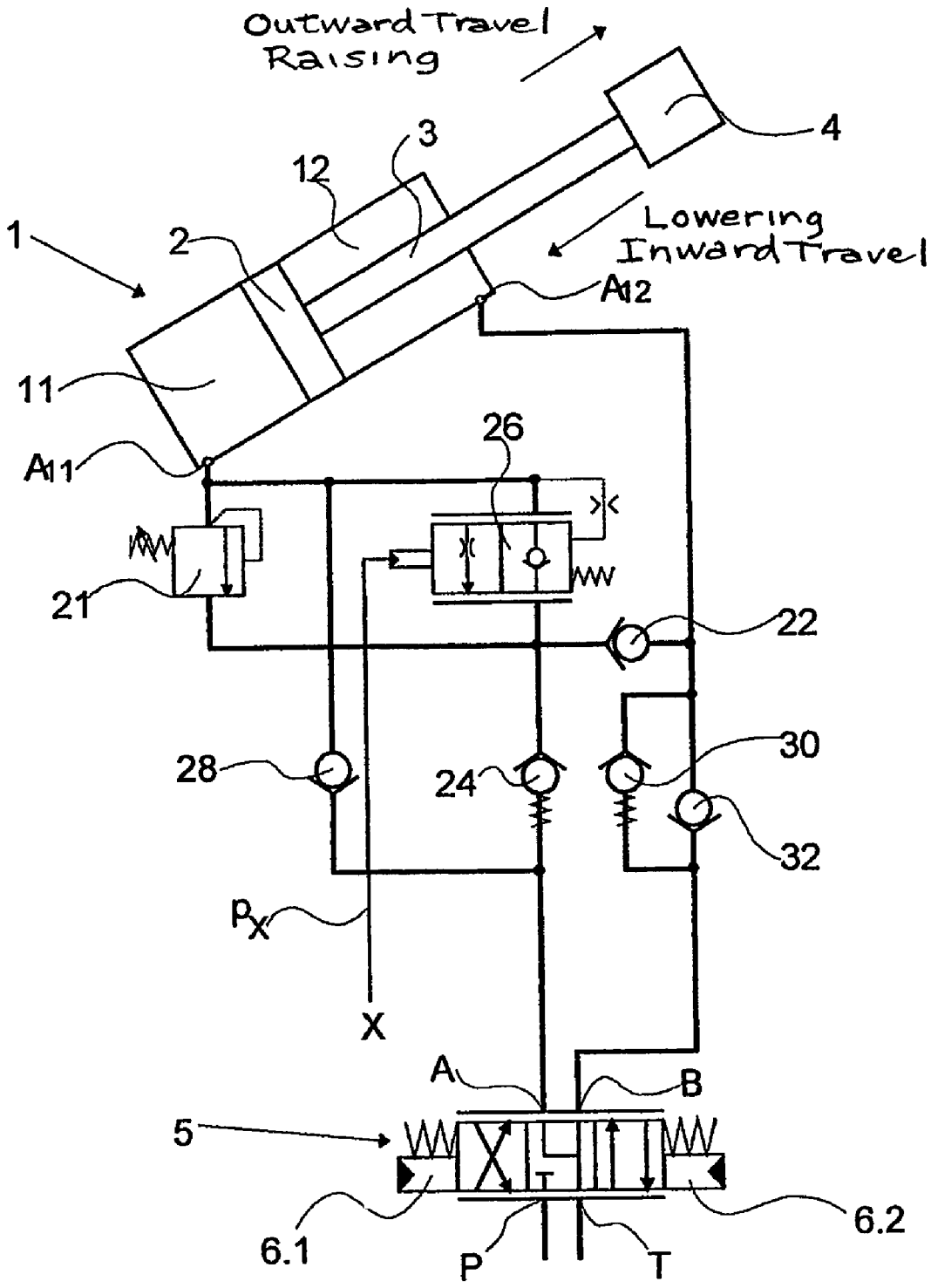
FIG. 1 shows a diagram of a circuit for controlling a double-action hydraulic drive cylinder.

FIG. 1 shows a double-action hydraulic drive cylinder 1, in which a load 4 can be moved by a piston 2 and a piston rod 3 connected to the piston. The drive cylinder 1 can be controlled by a directional control valve 5, which can be actuated in the known manner by drives 6. The directional control valve 5 has a pump port P in the conventional manner, a tank port T, a first working port A, and a second working port B.

A first drive 6.1 moves the directional control valve 5 into the position in which the pump port P is connected to the working port B and in which the tank port T is connected to the working port A in the known manner. A second drive 6.2 moves the directional control valve 5 into the position in which the pump port P is connected to the working port A, and in which the tank port T is connected to the working port B. If drive 6 is not actuated, the directional control valve 5 assumes the position shown, which represents the neutral position of the directional control valve 5.

The drive cylinder 1 has a piston space 11 and a rod space 12. The "raising" function for the load 4 can be obtained by supplying hydraulic oil to the piston space 11 while hydraulic oil is being discharged simultaneously from the rod space 12; by supplying hydraulic oil to the rod space 12 while hydraulic oil is being discharged simultaneously from the piston space 11, the "lowering" function is implemented. As previously mentioned, the inflowing and outflowing quantities of hydraulic oil are not the same, because the cross section of the piston space 11 is different from that of the rod space 12.

According to the invention, a piston-space port $A_{11}$ on the piston space 11 is connected by way of a pressure-limiting valve 21 and an automatic regeneration check valve 22, which requires no actuation, to a rod-space port $A_{12}$ on the rod space 12. By way of this connection, hydraulic oil is able to flow from the piston-space port $A_{11}$ to the rod-space port $A_{12}$, as will be described in detail further below.

The pressure-limiting valve 21 limits the pressure in the piston space 11. When the piston 2 with the rod 3 travels inward into the drive cylinder 1, this pressure-limiting valve 21 opens when the pressure in the piston space 11 is higher than the pressure set on the pressure-limiting valve 21. This allows hydraulic oil to leave the piston space 11, which thus reduces, i.e., limits, the pressure. Depending on the operating conditions, the hydraulic oil flows along different routes. The pressure-limiting valve 21 also protects the drive cylinder 1 from external loads.

The regeneration check valve 22 opens automatically when the pressure on the side facing the piston-space port $A_{11}$ is higher than the pressure on the side facing the rod-space port $A_{12}$. Thus regeneration is possible from the piston space 11 to the rod space 12 without the need for the actuation of any additional control means.

As previously mentioned, FIG. 1 shows the neutral position of the directional control valve 5. The two drives 6 are not actuated. Thus the two working ports A, B are connected to the tank port T. The pump port P is blocked.

A connecting line branches off between the pressure-limiting valve 21 and the automatic regeneration check valve 22; this line proceeds by way of a first precharge valve 24 to the working port A of the directional control valve 5, and, according to the invention, it also proceeds by way of a load-holding valve 26 to the piston-space port $A_{11}$. The load-holding valve 26 can be actuated by a control pressure $p_x$, which is present at a control pressure port X.

A first automatic bypass check valve 28 is installed parallel to the first precharge valve 24 and the load-holding valve 26. As a result, the blocking effect of the first precharge valve 24 and the load-holding valve 26 in one direction can be bypassed, so that hydraulic oil can flow from the working port A of the directional control valve 5 to the piston-space port $A_{11}$ when the directional control valve 5 is actuated accordingly. There is no need for a control intervention.

Two check valves are connected in antiparallel fashion between the working port B of the directional control valve and the rod-space port $A_{12}$, namely, a second precharge valve 30 and a second automatic bypass check valve 32. The second precharge valve 30 is therefore connected between the rod space 12 and the tank in series with the directional control valve 5.

As a result of the inventive serial arrangement of the load-holding valve 26 and the regeneration check valve 22 between the piston-space port $A_{11}$ and the rod-space port $A_{12}$, it is now possible, when the directional control valve 5 is in the neutral position, i.e., the position in which the pump port P is blocked and the two working ports A, B are connected to the tank port T, to have the rod travel into the drive cylinder by actuating the load-holding valve 26. Under the action of the load 4, the pressure in the piston space 11 is higher than that in the rod space 12. When the load-holding valve 26 is actuated with a control pressure $p_x$, the valve opens, and the hydraulic oil can flow via the regeneration check valve 22 into the rod space 12 without the need for any other control intervention.

On account of the difference between the cross section of the piston space 11 and that of the rod space 12, however, the movement of the piston 2 causes more hydraulic oil to flow out of the piston space 11 than the rod space 12 can hold. For this reason, the amount of oil representing the difference will leave via the first precharge valve 24 and/or the via the second precharge valve 30 and thus via the working ports A and/or B to the tank port T and finally arrive at the tank. The inward travel, identical in this case to the lowering of the load 4, therefore occurs without the need for the pump to deliver any power. The precharge valves 24, 30 have the effect that only the amount of oil representing the difference is carried away. They are therefore essential to the invention.

Figure 2:
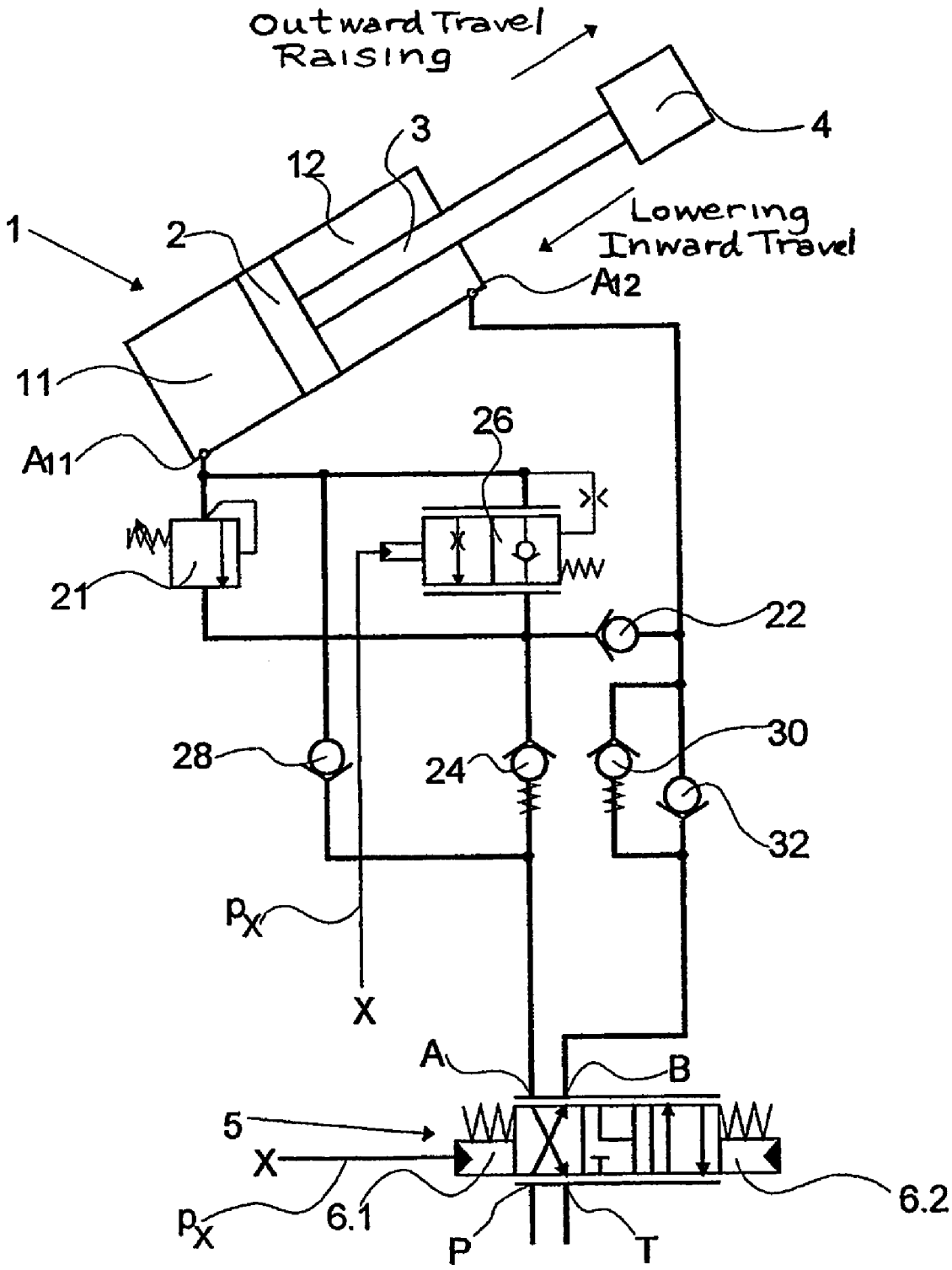
FIG. 2 shows the same diagram in a different operating state.

FIG. 2 shows a diagram similar to that of FIG. 1, except that now the directional control valve 5 is in a different position, namely, the position in which the pump port P is connected to the working port B and in which the tank port T is connected to the working port A. This different position is reached by the action of the previously mentioned control pressure $p_x$, which actuates the first drive 6.1. When the pump starts to convey hydraulic oil, the oil flows via the directional control valve 5 and the second bypass check valve 32 to the rod space 12. Simultaneously, hydraulic oil flows from the piston space 11, through the load-holding valve 26, which has also been actuated in this case, and through the regeneration check valve 22 to the rod space 12. Because of the different cross sections of the piston space 11 and the rod space 12, the amount of oil representing the difference is again discharged via the first precharge valve 24 and thus via the working port A of the directional control valve 5 to the tank port T and thus into the tank.

The operating mode shown in FIG. 2 results in faster movement than that of the operating mode of FIG. 1. This high-speed circuit, however, requires only a small amount of energy for the pump, because here, too, the portion of the hydraulic oil which flows directly from the piston space 11 via the load-holding valve 26 and the regeneration check valve 22 into the rod space 12 does not have to be conveyed by the pump.

FIGS. 1 and 2 show states in which the load 4 acts above the drive cylinder 1, because the drive cylinder 1 is at such an angle that the load-side end of the piston rod 3 is higher than the piston-side end of the piston rod 3. With an arrangement of this type, outward travel means the raising of the load 4, whereas inward travel means the lowering of the load. There are applications in which the hydraulic drive cylinder 1 always occupies this position.

Figure 3:
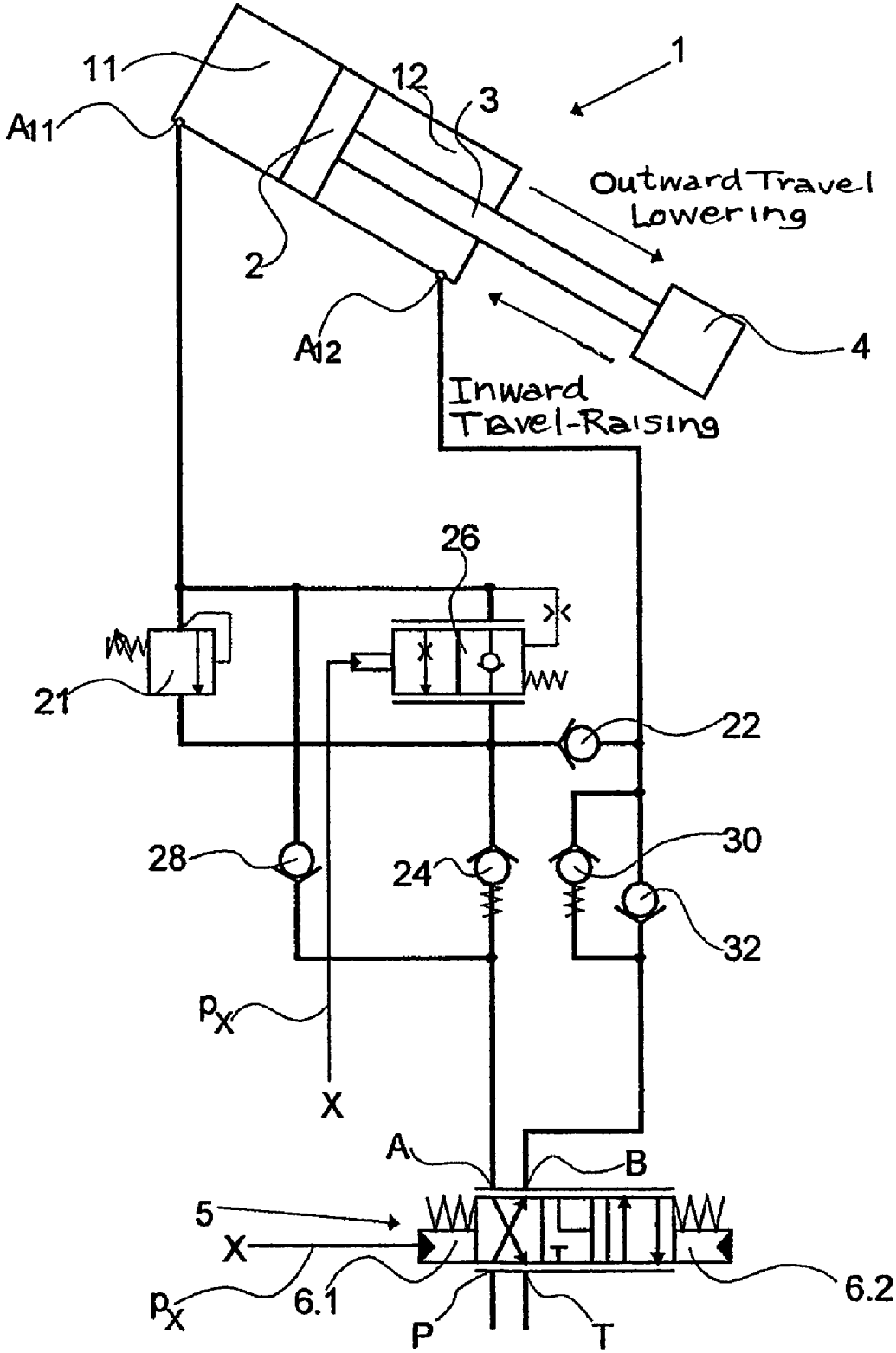
FIG. 3 shows a diagram with the drive cylinder in a different position.

But there are also applications in which the hydraulic drive cylinder 1 assumes a different angle. This is shown in FIG. 3. Here the load 4 acts below the drive cylinder 1, because the drive cylinder is at such an angle that the load-side end of the piston rod 3 is lower than the piston-side end of the piston rod 3. As a result, inward travel means the raising of the load 4, and outward travel means the lowering of the load 4.

Actuation of the load-holding valve 26 according to FIG. 1 is not enough in itself to cause inward travel, because the load 4 does not push on the piston 2 but rather pulls on it. Accordingly, to make the piston travel inward, which in this case means the raising of the load 4, the energy necessary to raise the load 4 must be supplied by operating the pump. The inventive circuit, however, easily handles this operating state. There is no need to provide and any additional control means and to actuate them.

In this case, the load-holding valve 26 and the directional control valve 5 are actuated in the same way as in the case of FIG. 2. The control pressure $p_x$ acts on both the load-holding valve 26 and the first drive 6.1 of the directional control valve 5. For this reason, the directional control valve 5 is in the position shown, in which the pump port P is connected to the working port B and the tank port T is connected to the working port A. The pump therefore conveys hydraulic oil from the pump port P via the working port B, through the second bypass check valve 32, which now opens, and finally through the rod-space port $A_{12}$ into the rod space 12. As a result, hydraulic oil is displaced from the piston space 11, and this oil flows via the piston-space port $A_{11}$, through the load-holding valve 26, which is now opening because of its actuation, through the automatically opening first precharge valve 24 and the connection existing in the directional control valve 5 from the working port A to the tank port T and thus finally to the tank. The pressure in the rod space 12 is higher than the pressure in the piston space 11, and this has the result that the regeneration check valve 22 remains closed. In this operating mode, therefore, no regeneration occurs.

Figure 4:
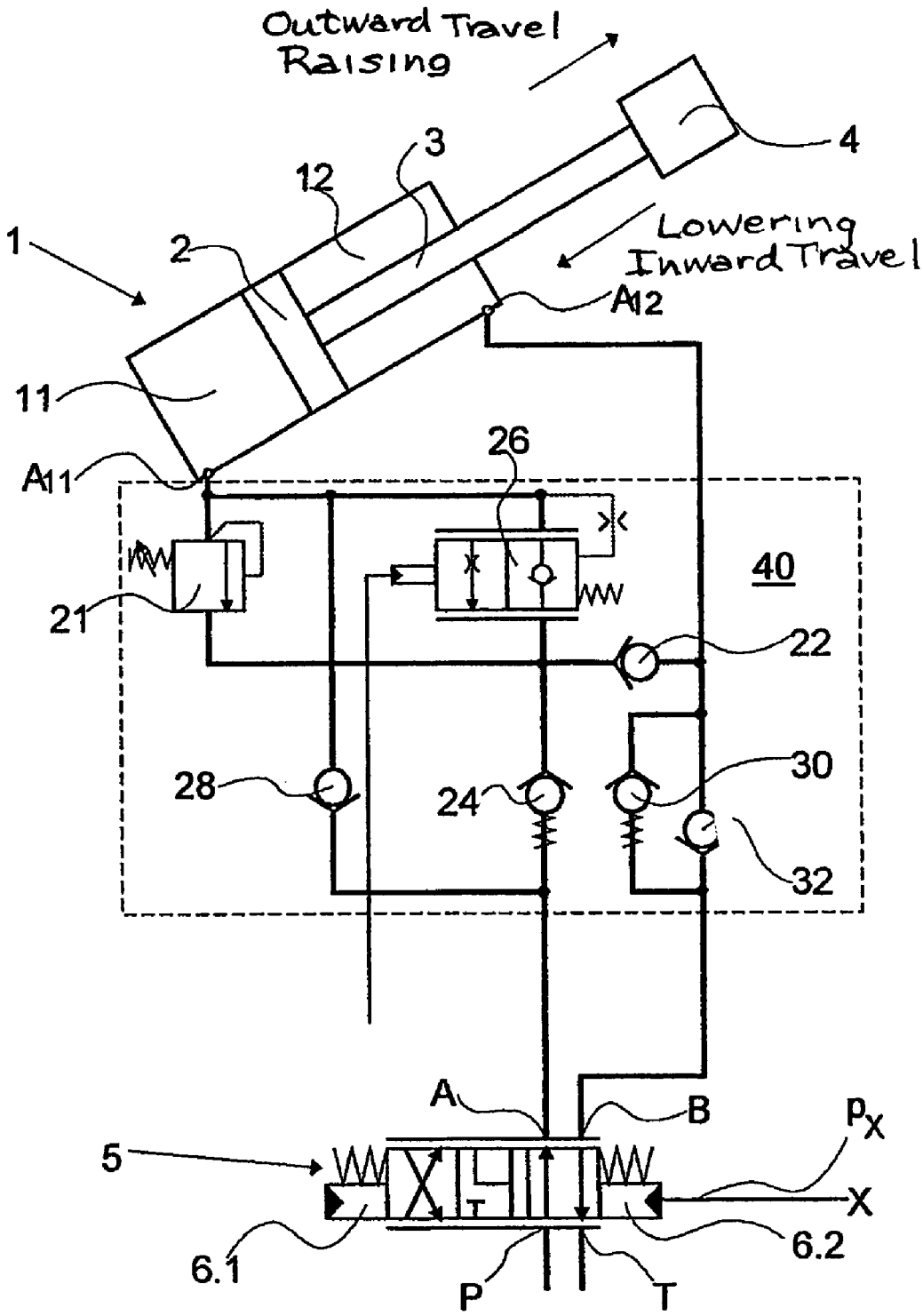
FIG. 4 shows a diagram for the "outward stroke" operating mode.

FIG. 4 shows the "outward travel" operating mode. As a result of the actuation of the second drive 6.2, the directional control valve 5 assumes the position shown, in which the pump port P in the directional control valve 5 is connected to the working port A, and the working port B is connected to the tank port T. The hydraulic oil conveyed by the pump flows from the pump port P to the working port A and through the automatically opening first bypass check valve 28 to the piston space 11. Simultaneously, hydraulic oil is displaced from the rod space 12, and this oil flows via the automatically opening second precharge valve 30 and via the connection existing in the directional control valve 5 from the working port B to the tank port T to the tank. The load-holding valve 26 is not actuated, and the regeneration check valve 22 is closed.

Outward travel is independent of the spatial position of the hydraulic drive cylinder 1. If the drive cylinder 1 is in the position shown, outward travel means the raising of the load 4. If the drive cylinder is in the position shown in FIG. 3, outward travel means the lowering of the load. The power to be supplied by the pump, of course, will be different in the two cases.

The pressure-limiting valve 21 belonging to the invention has the purpose of protecting the drive cylinder 1 from excessive load during inward travel. If the pressure in the piston space 11 becomes higher than the pressure set on the pressure-limiting valve 21, the pressure-limiting valve 21 will open, and hydraulic oil would flow via the regeneration check valve 22 to the rod space 12 and/or via the precharge valve 24 and the directional control valve 5 to the tank. The route taken depends on the operating conditions at the time in question.

It is advantageous to combine the pressure-limiting valve 21, the regeneration check valve 22, the first precharge valve 24, and the load-holding valve 26, the first bypass check valve 28, the second precharge valve 30, and the second bypass check valve 32 into a single valve block 40 and to mount this block directly on the drive cylinder 1.

Figure 5:
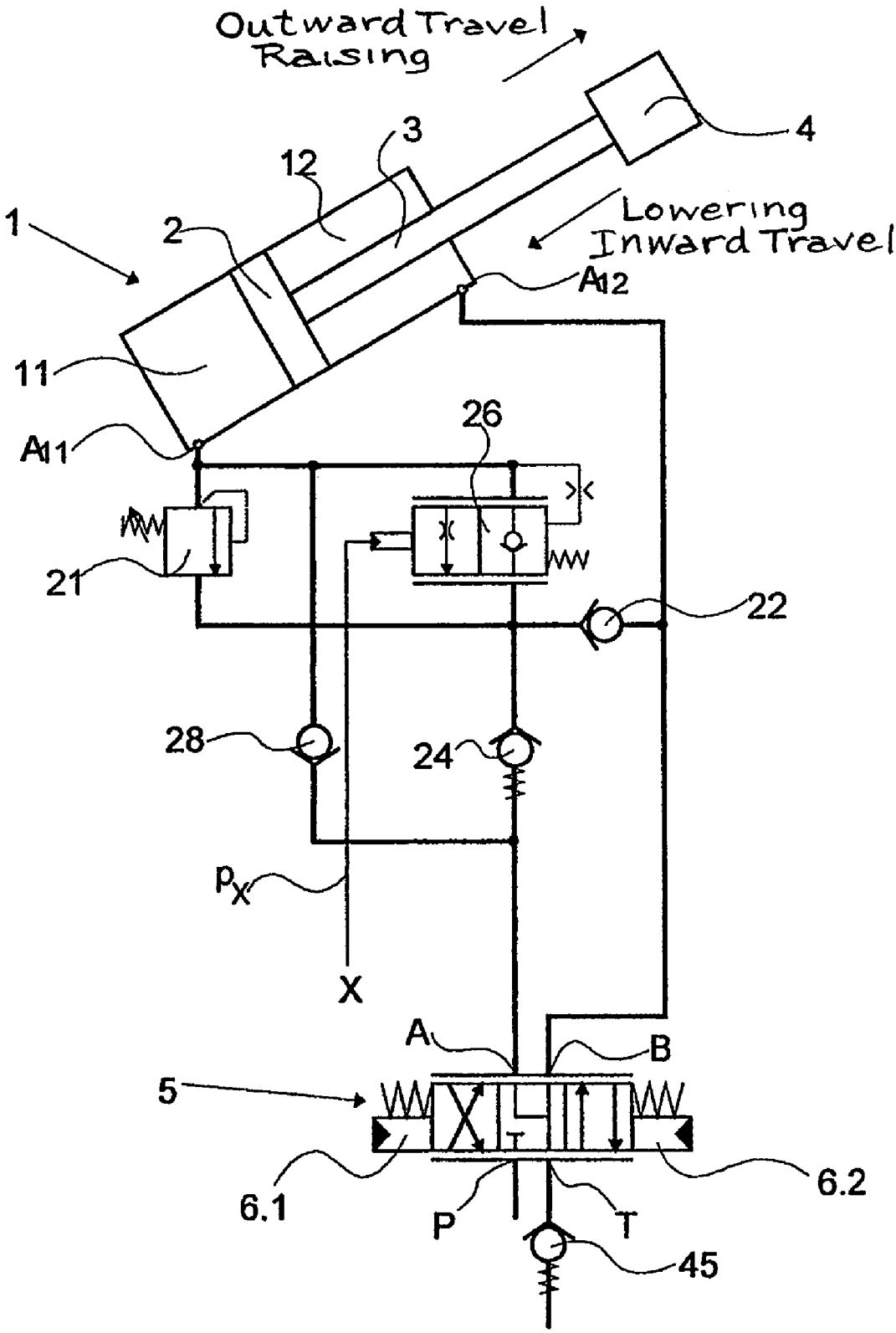
FIG. 5 shows a variant of the circuit.

FIG. 5 shows an advantageous variant of the invention. In principle, the circuit is the same as that according to FIG. 1, except that here the parallel circuit of the second precharge valve 30 and the second bypass check valve 32 is missing. Thus there is a direct connection between the working port B and the rod space 12. The prepressurization of the rod space 12 necessary for the inventive operation of the circuit is achieved by means of an additional precharge valve 45 installed in the tank line between the tank port T and the tank. This additional valve therefore assumes the function of the second precharge valve 30 according to FIGS. 1-4. The previously described operating behavior is not changed by this. The precharge valve 45 is also connected in series with the directional control valve 5 between the rod space 12 and the tank.

Figure 6:
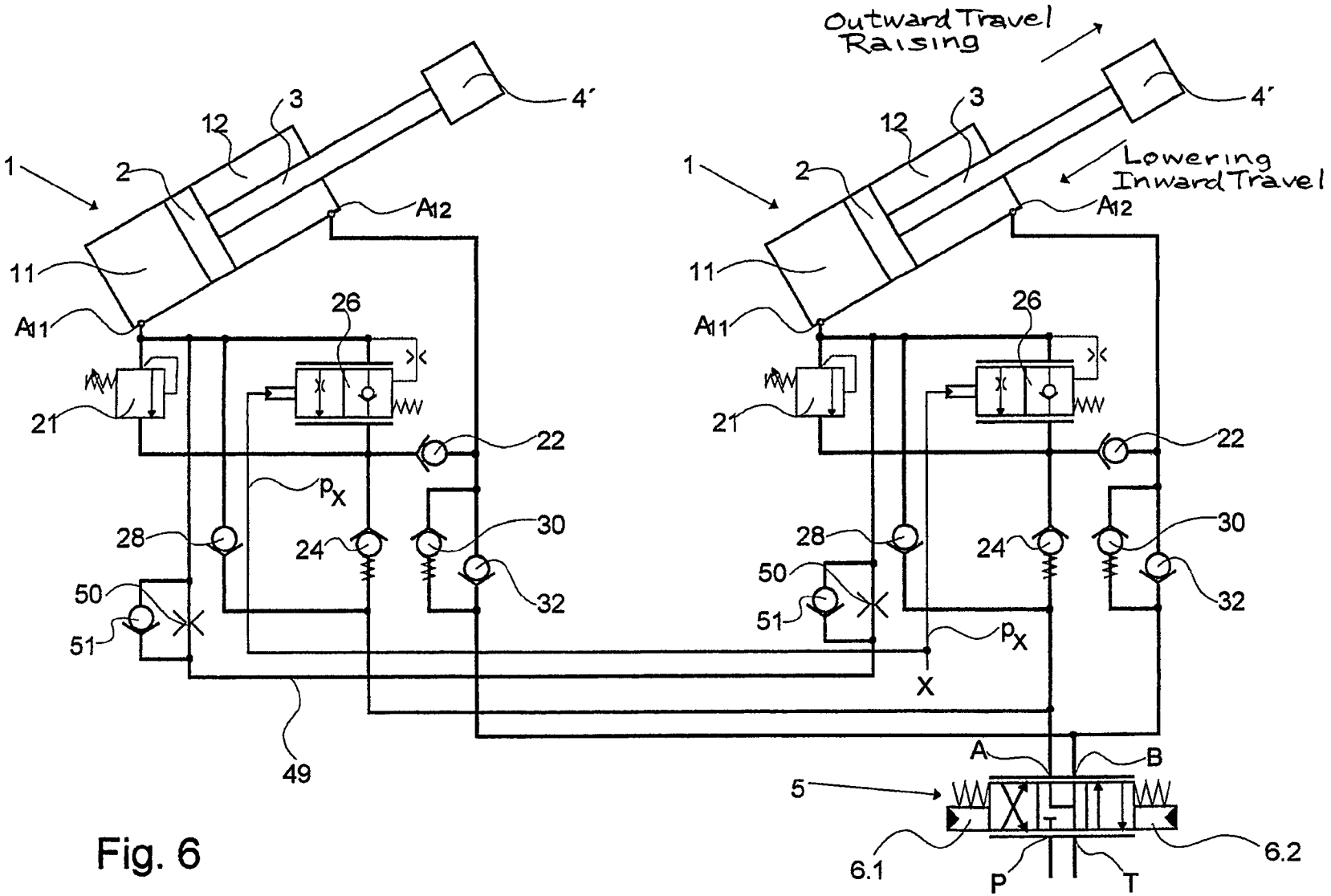
FIG. 6 shows a diagram for the operation of two parallel drive cylinders.

FIG. 6 shows two drive cylinders 1, working in parallel. Both act on the same load 4'. An arrangement like this is used when the load 4' is very heavy. Each drive cylinder 1 is actuated by a similar circuit, corresponding to that shown in FIG. 1. The same reference numbers refer to the same parts as those shown in FIG. 1. The two drive cylinders 1 are actuated in parallel by a single directional control valve 5, so that they are connected in exactly the same way to the working ports A and B of the directional control valve 5. The two load-holding valves 26 are also actuated in parallel by the control pressure $p_x$.

So that two drive cylinders 1 can be operated in parallel in this way, however, it is necessary to provide in addition a compensating line 49, which connects the piston spaces 11 of the two drive cylinders 1 to each other. A compensating line nozzle 50 and a compensating line check valve 51 are also assigned to each of the drive cylinders 1. The nozzle and the valve are connected in parallel to each other in the compensating line 49. As a result, the pressures in the two piston spaces 11 remain equal. If the pressure in one of the piston spaces 11 becomes higher, hydraulic oil can flow from this piston space 11 to the piston space 11 of the other drive cylinder 1 to equalize the pressure, the hydraulic oil passing first through the closest compensating nozzle 50 and then through the compensating line check valve 51 assigned to the other drive cylinder 1.

The previously mentioned valve block 40 can include the directional control valve 5 and also the additional precharge valve 45, which may or may not be present.

As a result of the invention, it is possible for regeneration to occur from the piston space 11 to the rod space 12. Thus, when the piston travels inward, compressed hydraulic oil is not conveyed through the line—which is often very long—between the drive cylinder 1 and the directional control valve 5. Less energy is consumed to operate the pump, and the dynamic behavior of the drive cylinder is improved.

What is claimed is:

1. A circuit for controlling a double-action hydraulic drive cylinder having a piston separating a piston space from a rod space, wherein hydraulic oil can be supplied to the piston space while hydraulic oil simultaneously flows out of the rod space, and hydraulic oil can be supplied to the rod space while hydraulic oil simultaneously flows out of the piston space, the circuit comprising:

a directional control valve which actuates said hydraulic cylinder, the directional control valve comprising working ports A and B, a pump port P, and a tank port T, wherein the directional control valve has a neutral position in which the pump port P is blocked and the two working ports A, B are connected to the tank port T;

a parallel circuit comprising a pressure-limiting valve and a controllable load-holding valve connected to the piston space in parallel;

a regeneration check valve connected in series between the parallel circuit and the rod space, the regeneration check valve, the pressure-limiting valve, and the controllable load-holding valve check valve being connected to each other at a connection point;

a first precharge valve connected between the working port A and the connection point, the first precharge valve permitting flow from the connection point to the working port A;

a first bypass check valve in parallel with the first precharge valve and the load-holding valve, the first bypass check valve permitting flow from the working port A to the piston space; and a second precharge valve connected in series with the directional control valve between the tank port P and the rod space.

2. The circuit of claim 1 wherein the second precharge valve is installed between the working port B of the directional control valve and the rod space, the second precharge valve permitting flow from the rod space to the working port B, the circuit further comprising a second bypass check valve in parallel with the second precharge valve, the second bypass check valve permitting flow from the working port B to the rod space.

3. The circuit of claim 2 wherein the pressure limiting valve, the regeneration check valve, the first precharge valve, the controllable load-holding valve, the first bypass check valve, the second precharge valve, and the second bypass check valve are combined into a single valve block which is mounted directly on the drive cylinder.

4. The circuit of claim 1 further comprising an additional precharge valve installed between the tank port T and a tank.

5. A circuit for controlling a pair of double-action hydraulic drive cylinders connected in parallel, each drive cylinder having a piston separating a piston space from a rod space, wherein hydraulic oil can be supplied to the piston space while hydraulic oil simultaneously flows out of the rod space, and hydraulic oil can be supplied to the rod space while hydraulic oil simultaneously flows out of the piston space, the circuit comprising compensating line which connects the piston spaces, and a directional control valve which actuates said hydraulic drive cylinders jointly, the directional control valve comprising working ports A and B, a pump port P, and a tank port T, wherein the directional control valve has a neutral position in which the pump port P is blocked and the two working ports A, B are connected to the tank port T, the circuit further comprising, for each said drive cylinder:

a parallel circuit comprising a pressure-limiting valve and a controllable load-holding valve connected to the piston space;

a regeneration check valve connected in series between the parallel circuit and the rod space, the regeneration check valve, the pressure-limiting valve, and the controllable load-holding valve check valve being connected to each other at a connection point;

a first precharge valve connected between the working port A and the connection point, the first precharge valve permitting flow from the connection point to the working port A;

a first bypass check valve in parallel with the first precharge valve and the load-holding valve, the first bypass check valve permitting flow from the working port A to the piston space;

a second precharge valve between the working port B and the rod space, the second precharge valve permitting flow from the rod space to the working port B;

a second bypass check valve in parallel with the second precharge valve, the second bypass check valve permitting flow from the working port B to the rod space; and a compensating line nozzle and a compensating line check valve arranged in parallel in the compensating line, whereby hydraulic oil can flow from one of said piston spaces to the other of said piston spaces via said nozzles and one of said compensating line check valves, and hydraulic oil can flow from the other of said piston spaces to said one of said piston spaces via said nozzles and the other of said compensating line check valves.

* * * * *